United States Patent [19]

Parry et al.

[11] Patent Number: 4,872,623

[45] **Date of Patent: * Oct. 10, 1989**

[54] FILM ROLL HOLDER WITH DRUM BRAKE

[75] Inventors: Daniel J. Parry; John C. Parry, both of Severna Park, Md.

[73] Assignee: J. C. Parry & Sons, Inc., Baltimore, Md.

[ * ] Notice: The portion of the term of this patent subsequent to Feb. 2, 2005 has been disclaimed.

[21] Appl. No.: 150,964

[22] Filed: Feb. 1, 1988

Related U.S. Application Data

[63] Continuation-in-part of Ser. No. 924,442, Oct. 29, 1986, Pat. No. 4,722,493.

[51] Int. Cl.[4] ..... B65H 75/02

[52] U.S. Cl. ..... 242/96; 242/99

[58] Field of Search ..... 242/96, 99, 75.4, 68.3, 242/68.5, 68.6, 55.2, 156, 156.2

[56] References Cited

U.S. PATENT DOCUMENTS

| | | | |
|---|---|---|---|
| 2,753,131 | 12/1954 | Erdman | 242/96 |
| 4,071,200 | 1/1978 | Stone | 242/55.2 |
| 4,166,589 | 9/1979 | Hoover et al. | 242/75.4 |
| 4,179,081 | 12/1979 | Parry | 242/99 |
| 4,248,392 | 2/1981 | Parry | 242/96 |
| 4,477,037 | 10/1984 | Goldstein | 242/75.4 |
| 4,484,717 | 11/1984 | Goldstein | 242/96 |
| 4,522,348 | 6/1985 | Strout et al. | 242/96 |
| 4,530,473 | 7/1985 | Parry | 242/96 X |
| 4,535,951 | 8/1985 | Riemenschneider, III | 242/75.4 |
| 4,575,020 | 3/1986 | Strout et al. | 242/96 |
| 4,582,273 | 4/1986 | Saraisky | 242/96 |
| 4,722,493 | 2/1988 | Parry et al. | 242/99 X |

FOREIGN PATENT DOCUMENTS

| | | | |
|---|---|---|---|
| 2717728 | 10/1978 | Fed. Rep. of Germany | 242/96 |

*Primary Examiner*—John M. Jillions

*Attorney, Agent, or Firm*—Hoffman, Wasson, Fallow & Gitler

[57] ABSTRACT

A holder for dispensing stretch film from a roll comprises a cylindrical body and an arbor rotatably supported on the body. A flexible grip having internal ribs covers the body and the arbor, so that one can, by applying finger pressure to the grip, brake rotation of the arbor and thus control film tension. A snap-assembly construction is provided between the arbor and the shaft upon which it is installed.

12 Claims, 4 Drawing Sheets

FIG. 5.
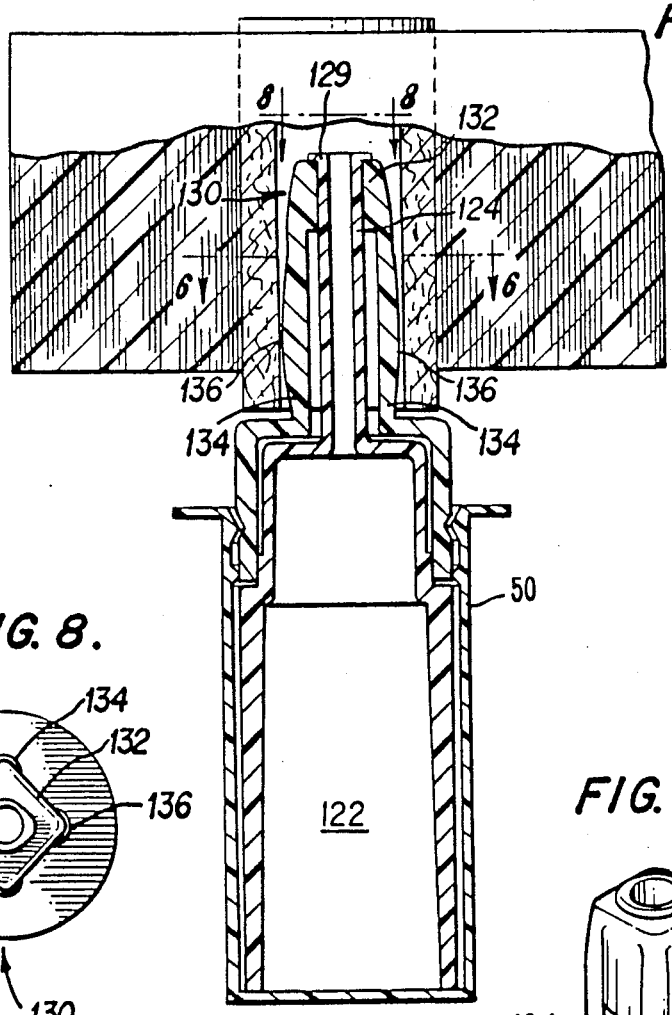
FIG. 8.
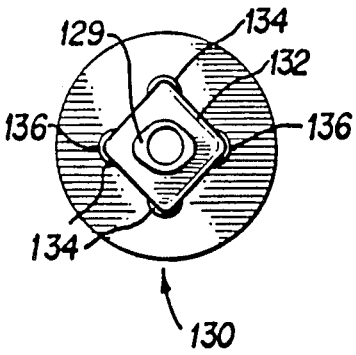
FIG. 7.
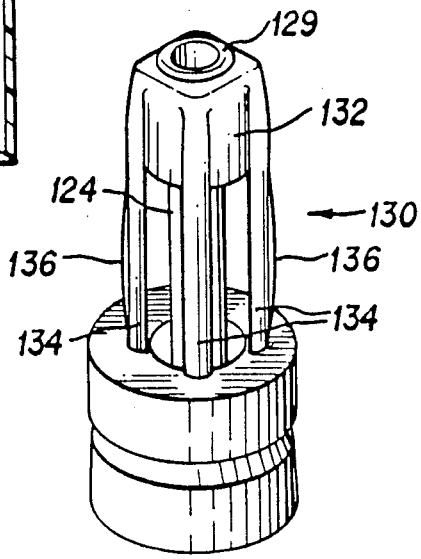
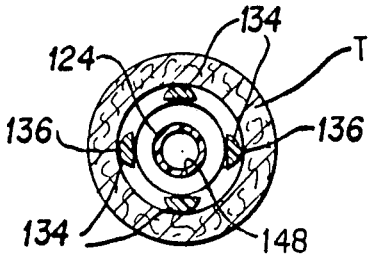
FIG. 6

FILM ROLL HOLDER WITH DRUM BRAKE

This application is a continuation-in-part of copending application Ser. No. 924,442, filed Oct. 29, 1986, now U.S. Pat. No. 4,722,493.

BACKGROUND

This invention relates to the art of packaging, in particular to a device for dispensing highly stretchable plastic film as a packaging medium.

The growth of the stretch film wrap industry has created demand for devices capable of paying out film under tension as it is wrapped around a package or the like. There are already several such devices in existence, including those shown in U.S. Pat. Nos. 4,179,081 and 4,248,392 issued to John C. Parry. Those patents disclose devices comprising a flexible grip that, when squeezed, applies a braking force to the core of a film roll, whereby the user can control film tension by squeezing the grips more or less, to brake the film roll. These devices are particularly useful for applying stretch film of substantial width, e.g., twenty inches, and are generally used in pairs, one on either end of the roll.

Other dispensers, some for one-hand operation, have been marketed for dispensing film of narrow widths, on the order of one to four inches. At least one such dispenser includes a spring-biased break between the handle thereof and the dispensing reel. The bias may be adjusted to provide a preset film tension; however, this tension cannot be varied in use. It is also possible to use grips, as shown in the earlier Parry patents, singly for narrow rolls, but the twisting torque occurring in one-hand operation makes it difficult (or impossible, depending on film width) to control the braking force. A good, inexpensive film dispenser for one-hand stretch wrapping is needed.

It is therefore an object of this invention to provide the industry with a one-hand dispenser for paying out stretch film under controlled tension. A related object is to allow one to vary film tension readily while wrapping an item.

Another object is to eliminate the need to adjust brake settings from item to item or between different gauges or widths of wrapping material.

Accordingly, we have developed a film dispenser for one-hand use. This dispenser, described in detail below, is characterized by a handle with an arbor journalled thereon, for supporting a roll of film, and a resilient grip overlying both the handle and the arbor, so that by varying the pressure distribution on the grip between the fingers, one can control the braking force on the roll. The resilient grip has internal longitudinal ribs whose crests engage only a small portion of the arbor surface at any one time, thus permitting controlled braking of longer rolls, which was previously inevitable. Other advantages will be apparent from the following detailed description, taken in conjunction with the accompanying drawings.

BRIEF DESCRIPTION OF DRAWINGS

FIG. 5 is a view, corresponding to FIG. 2, of a second embodiment of the invention.

FIG. 6 is a sectional view taken along the line 6—6 in FIG. 5.

FIG. 7 is a perspective view of the arbor portion of FIG. 5.

FIG. 8 is an end view of the second embodiment, taken along the line 8—8 in FIG. 5.

DESCRIPTION OF THE PREFERRED EMBODIMENTS

Figure 2:
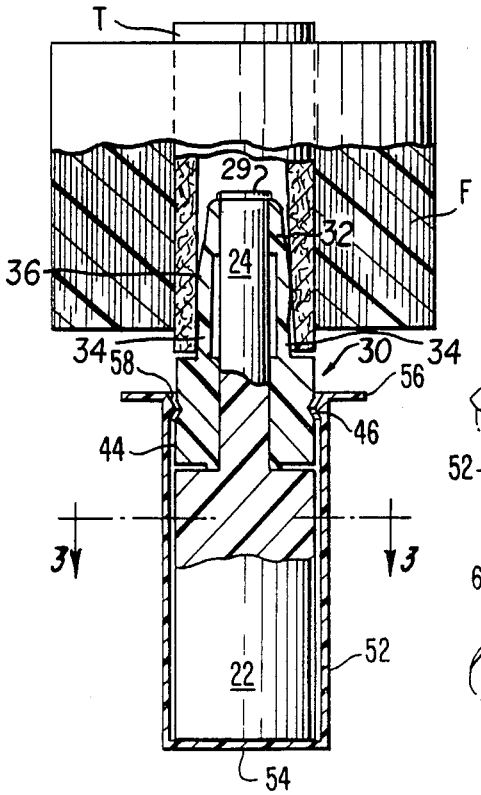
FIG. 2 is a sectional view of a preferred dispenser embodying the invention taken along the line 2—2 in FIG. 1.
Figure 3:
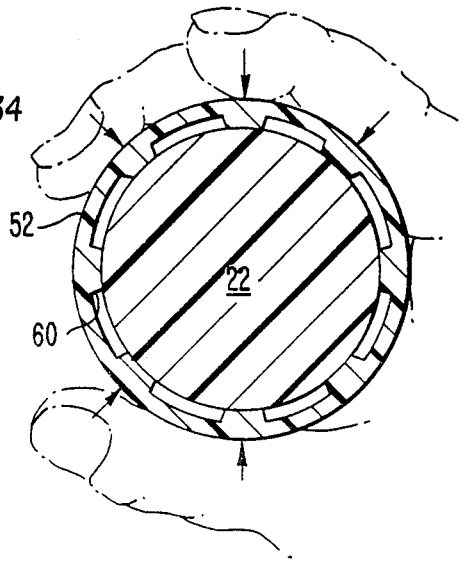
FIG. 3 is a sectional view through the dispenser, taken along the radial plane 3-3 in FIG. 2.
Figure 4:
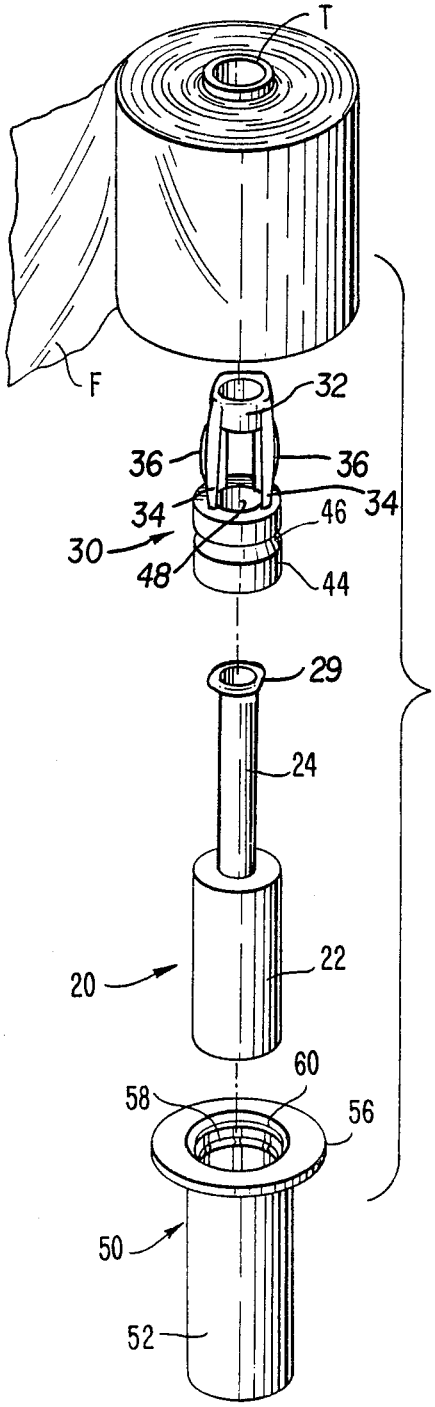
FIG. 4 is an exploded perspective view of the dispenser shown in FIG. 2.

FIGS. 2–4 show a film dispenser embodying the invention. The dispenser comprises three components: a handle 20, an arbor 30 journalled on the handle, and a resilient grip 50 that covers the handle and a portion of the arbor assembly.

The handle 20 is manufactured from a single piece of high-density plastic material such as rigid polyvinyl chloride. The major portion of the handle defines a cylindrical body 22, from one end of which an integral shaft 24 extends. The shaft terminates at a distal tip having an elliptical or lemon-shaped tip 29, best shown in FIG. 4, capable of sufficient inward deformation when under assembly forces to pass through the bore 48 of the arbor, and to retain the arbor on the shaft thereafter.

The arbor 30, may be made of acrylonitrile, butadiene, styrene or other material compatible with that of the handle. It includes, at one end, a nose portion 32 preferably having the shape of a truncated gradrangular pyramid or any shape capable of being inserted into the core tube of a roll of film. The arbor nose 32 is connected to a collar 44 at the opposite end of the arbor by plural (preferably four) longitudinally extending struts 34 (FIG. 4) which, owing to the material from which they are made, can be elastically deformed inwardly by the core tube T upon assembly; these struts maintain an outward pressure against the inside diameter of the tube to enable torque to be transferred from the tube to the arbor. The struts are bowed outward slightly in their undeformed state. Furthermore, a plurality (preferably two) of the struts have thin molded crescent-shaped blades 36 protruding radially therefrom to further increase the torque capability. The arbor has a circumferential detent groove therein, whose purpose is described below.

The arbor 30 has an axial throughbore 48 whose diameter is slightly larger than the diameter of the shaft 24, so as to permit free rotation of the arbor when it is assembled onto the shaft, but smaller than the shaft tip, to provide reliable retention, as described above.

The grip 50 is injection molded from a resilient plastic material, for example polyvinyl chloride. Resembling a motorcycle handgrip, it includes a sleeve 52 closed at one end by an end cap 54. The opposite end of the grip is open, and has an outwardly projecting flange or guard 56 to prevent one's hand from contacting the film roll. As FIG. 4 shows, there is an internally projecting circumferential ridge 58 inside the grip near its open end, which ridge comes to rest in groove 46 when the grip is pushed onto the handle and arbor assembly, so as to keep the grip in place.

An important feature of the invention is the provision of ribs 60 extending lengthwise along the interior surface of the grip. The ribs extend over at least that portion of the grip surrounding the arbor, and preferably span the entire length of the grip. Thus, only the protruding ribs 60 contact the exterior surface of the arbor, as seen from FIG. 3.

The grip does not fit tightly upon the arbor collar 44. The fit may be close enough to provide a slight amount of drag, but any substantial normal force between the parts must be developed by manual pressure, as suggested by the arrows in FIG. 3.

Figure 1:
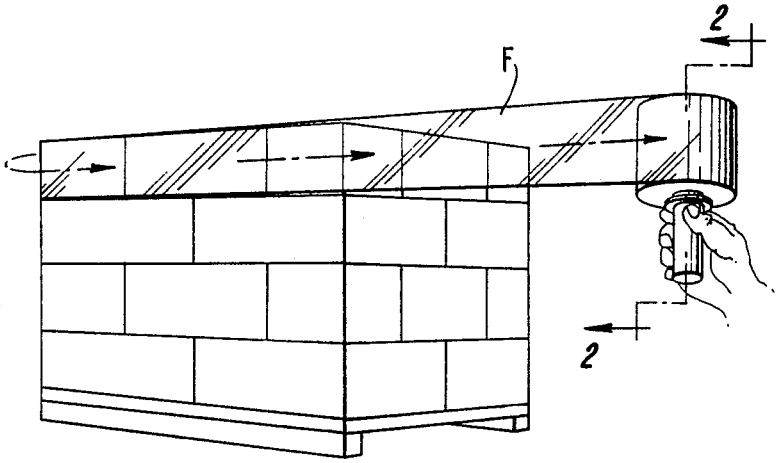
FIG. 1 is a perspective view of a stack of packages on a pallet, being wrapped with film with the use of this invention.

In use, a roll of stretch film F, wound on a core such as a paper tube T, is placed over the nose portion of the arbor, as shown in FIG. 2. (The tapered construction of the nose facilitates this step.) The leading end of the film is held against or attached to the items to be wrapped, FIG. 1, and the dispenser is moved several circuits around the item. Alternatively, the item may be rotated, as by a turntable, to reduce operator fatigue.

The film for which this dispenser is designed is characterized by its stretchability. The preferred film is a blend of copolymers, which is available in standard, twenty-inch wide rolls that we sever to produce the one-to-four inch widths for which the present invention is especially useful. This type of film can withstand elongations of up to 700%, making it ideal for wrapping irregularly shaped items, and giving the user wide latitude in the magnitude of stretch developed. The great stretchability of the film gives one the creative freedom to follow various paths around an object, and the film readily adapts to irregular surfaces. The primary functions of the dispenser are to support the film roll and to provide the desired film tension during the wrapping procedure.

It may be desirable to vary the film tension greatly from point to point on the item. With the described dispenser, one can continually vary film tension merely by varying the force applied to the outside of the grip sleeve by the forefinger and/or the thumb. Pressure so applied generates a contact force between the ribs 60 and the arbor collar 44, whereupon the collar functions as an external brake drum and the ribs as lining material tending to resist rotation of the arbor, and thus the film roll. Film tension, and hence the degree of stretch, is a direct function of the squeezing force applied.

It is important to note that braking is done by the ribs only where they contact the arbor surface. Any force applied by the fingers to that portion of the grip overlying the handle body 22 do not generate a braking force, since there is no relative rotation between those parts. Therefore, braking torque is variable independently of one's total gripping or squeezing force. This feature is particularly advantageous when dispensing from rolls having substantial length, for in that case, film tension creates a large torque about an axis perpendicular to the axis of the film roll. When this torque is resisted by the user, a reaction appears in the form of a force couple applied by the thumb and little finger, for example. In prior devices wherein the whole length of the grip was effective as a brake lining, large braking forces would unavoidably be generated by the reaction forces in this situation, whether or not great brake torque was required. With the instant device, the force couple may be applied wholly or partially to that portion of the handgrip overlying the handle body, not the arbor, to avoid undesired braking.

Another function of the ribs is to protect the user's hand from uncomfortable temperatures that may be developed by the braking action.

FIGS. 5–8 show a modified form of the invention which differs from that shown in FIGS. 1–4 in two respects. The handle body 122 is hollow - permitting its manufacture by injection molding. The major diameter of the tip 129 is slightly larger than the bore 148 so that a snap assembly results when the arbor is pushed over the shaft. Both of these features make manufacture of the device simpler and less expensive, yet perfectly reliable.

Otherwise, this embodiment is structurally the same as the embodiment of FIGS. 1–4, corresponding elements being designated by reference numerals differing by one hundred from those of FIGS. 1–4. Operation of this embodiment is identical to that described previously.

Figure 9:
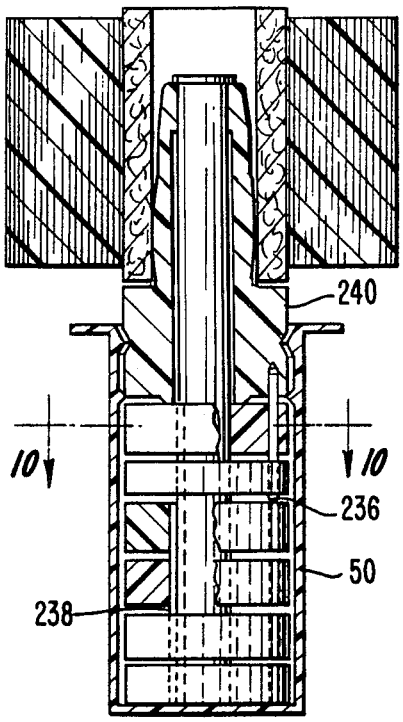
FIG. 9 is a view, corresponding to FIG. 2, of a third embodiment of the invention.
Figure 11:
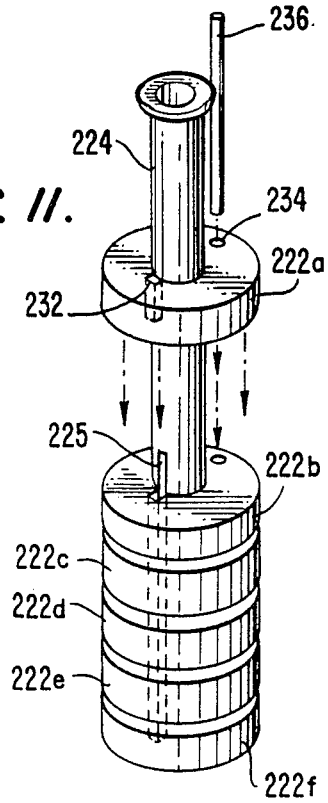
FIG. 11 is a perspective view of a portion of the third embodiment of the invention.
Figure 10:
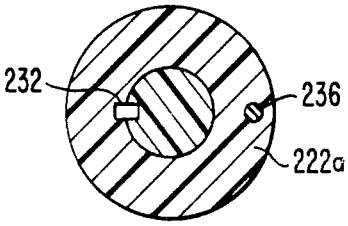
FIG. 10 is a sectional view of the third embodiment, taken along the line 10—10 in FIG. 9.

FIGS. 9–11 illustrate another modified form of the invention. The handle body in this embodiment is segmented, comprising a series of identical discs 222*a–f* as shown. The lowermost disc 222*f* may be firmly attached to, or formed integrally with the shaft. Each disc has a bore through which the shaft 224 passes, a keyway 232 adjacent the bore, and a small throughhole 234 radially spaced from the bore.

One can change the characteristics of the device during assembly by coupling a greater or lesser number of the discs to the arbor 240, while connecting the remainder to the handle shaft 224. The former coupling is achieved by installing a rod 236 of selected length through the holes 234 of the desired discs and into a corresponding hole in the arbor. Those discs effectively become part of the arbor, and their surfaces can be braked by squeezing the overlying portion of the grip. The remaining discs are connected to the shaft 224, which has a keyway 225 in this embodiment, by installing a key 238 of the appropriate length. The handgrip 50 is identical with that described above. One can, by this arrangement, produce a device in which selected (e.g., thumb, index and middle) fingers may be used for braking. The selection can easily be changed for different film widths or applications.

While the invention has been developed primarily for dispensing wrapping film, it may also find other uses, such as for dispensing adhesive tape or other web materials.

Two modifications of the invention have been described above, and inasmuch as other variations will occur to one of skill in the art, the foregoing description should be regarded as only illustrative of the invention described by the following claims.

We claim:

1. A holder for a roll of stretch film, comprising a handle including a substantially cylindrical body and a shaft extending from one end of said body, an arbor rotatably mounted upon said shaft, means on said arbor for engaging said film roll, thereby constraining the roll and the arbor to rotate together upon said shaft, and a collar on said arbor adjacent said handle body, whereby one holding said handle body may create a braking torque on said roll by applying radial pressure to said collar, wherein said arbor has an axial bore and said shaft has an enlarged tip having a major diameter greater than that of said bore, said tip being sufficiently elastically deformable to permit said arbor to be installed upon the shaft, and to retain the arbor thereafter, and further comprising a flexible hand grip around both said handle body and said collar to protect one's hand from discomfort and injury while transmitting said radial pressure to said collar.

2. The invention of claim 1, wherein said grip further comprises an external flange at one end thereof adjacent said roll to prevent hand-to-roll contact.

3. The invention of claim 1, wherein said grip has a closed end at one end thereof furthest from said roll.

4. The invention of claim 1, wherein said arbor collar has an external circumferential groove thereon and said grip has a corresponding internal ridge thereon to retain said grip.

5. The invention of claim 1, wherein said grip has plural internal ribs whereby only the tips of said ribs engage said collar, thereby preventing seizing and limiting heat transfer to the hand.

6. The invention of claim 5, wherein said ribs extend in a direction that is longitudinal with respect to said cylindrical body.

7. The invention of claim 1, wherein said body is comprised of a series of discs mounted upon said shaft and further comprising means for connecting each disc either to said shaft or to said arbor, whereby one may vary the length of said grip upon which one may effectively apply braking pressure with the fingers.

8. The invention of claim 7, wherein each of said discs has a longitudinally extending hole therein radially spaced from the center of the disc, and further comprising a rod extending from said arbor and through any number of said holes so as to increase or decrease the number of discs effective as brake drums.

9. The invention of claim 8, wherein each of said discs has an internal keyway, said shaft has a corresponding keyway, and further comprising a key installed in said keyways, the key having a length selected to connect to the shaft only those discs not connected to the arbor by said rod.

10. The invention of claim 1, wherein said arbor has a nose portion for insertion into a film roll tube, and wherein said means for engaging said film roll comprise a plurality of flexible struts extending longitudinally between said nose and said collar, said struts being inwardly elastically deformed upon insertion into said tube, to enable tongue to be transferred between said tube and said arbor.

11. The invention of claim 10, wherein at least some of said struts have a radially extending integral blade thereon to further assist in transferring torque.

12. The invention of claim 11, wherein said struts are bowed radially outward in their undeformed state.

* * * * *